US009817425B2

(12) United States Patent
Shim

(10) Patent No.: US 9,817,425 B2
(45) Date of Patent: Nov. 14, 2017

(54) SEMICONDUCTOR DEVICES AND SEMICONDUCTOR SYSTEMS

(71) Applicant: SK hynix Inc., Icheon-si, Gyeonggi-do (KR)

(72) Inventor: Jong Joo Shim, Icheon-si (KR)

(73) Assignee: SK hynix Inc., Icheon-si, Gyeonggi-do (KR)

( * ) Notice: Subject to any disclaimer, the term of this patent is extended or adjusted under 35 U.S.C. 154(b) by 48 days.

(21) Appl. No.: 14/846,364

(22) Filed: Sep. 4, 2015

(65) Prior Publication Data

US 2016/0291630 A1 Oct. 6, 2016

(30) Foreign Application Priority Data

Apr. 6, 2015 (KR) ..... 10-2015-0048677

(51) Int. Cl.
*G05F 3/20* (2006.01)

(52) U.S. Cl.
CPC ..... *G05F 3/20* (2013.01)

(58) Field of Classification Search
CPC ..... H03K 17/22; H03K 17/26; G06F 1/24; G06F 1/26; G05F 3/20
USPC ..... 327/306, 333, 331; 326/61–62, 80–81
See application file for complete search history.

(56) References Cited

U.S. PATENT DOCUMENTS 9,379,728 B1 * 6/2016 Singh ..... H03M 1/1023
9,412,468 B2 * 8/2016 Ko ..... G11C 7/14
2003/0016566 A1 1/2003 Yamaki et al.

FOREIGN PATENT DOCUMENTS

KR 1020090045499 A 5/2009

* cited by examiner

*Primary Examiner* — Dinh T Le
(74) *Attorney, Agent, or Firm* — William Park & Associates Ltd.

(57) ABSTRACT

A semiconductor system may include a first semiconductor device and a second semiconductor device. The first semiconductor device may output a training entry signal and a transmission signal. The second semiconductor device may generate selection codes and a control signal in response to the training entry signal. The second semiconductor device may adjust a level of a reference voltage signal for buffering the transmission signal in response to the selection codes and control a capacitance of an internal node. The reference voltage signal may be outputted from the internal node in response to the control signal.

13 Claims, 7 Drawing Sheets

SEMICONDUCTOR DEVICES AND SEMICONDUCTOR SYSTEMS

CROSS-REFERENCE TO RELATED APPLICATION

The present application claims priority under 35 U.S.C 119(a) to Korean Application No. 10-2015-0048677, filed on Apr. 6, 2015, in the Korean Intellectual Property Office, which is incorporated herein by reference in its entirety as set forth in full.

BACKGROUND

1. Technical Field

Various embodiments generally relate to a semiconductor system, and more particularly, to a semiconductor system including a semiconductor device.

2. Related Art

In general, a semiconductor system comprising a semiconductor device receives an external signal to generate an internal signal. The internal signal is used in an internal circuit of the semiconductor device. To generate the internal signal, the semiconductor system compares the external signal with a reference voltage signal. The internal signal has a logic level according to a comparison of the external signal and the reference voltage signal.

For example, the internal signal has a logic high level when a level of the external signal is higher than that of the reference voltage signal. Also, the internal signal may have a logic low level when the level of the external signal is lower than that of the reference voltage signal.

A level of the reference voltage signal inputted to the semiconductor system is typically set at a middle level between a predetermined maximum level and a predetermined minimum level. However, the level of the reference voltage signal varies excessively in response to its surroundings, a power noise of the semiconductor system, a wiring of PCB (Print Circuit Board) and a wiring of a semiconductor package. The occurrence of an improper logic level detection of the external signal by the semiconductor system may cause a malfunction within an internal circuit. To try and prevent the occurrence of an improper logic level detection, level range detection of the reference voltage signal may be used. In this way, the semiconductor system may properly receive the external signal.

SUMMARY

According to an embodiment, a semiconductor system may include a first semiconductor device and a second semiconductor device. The first semiconductor device may output a training entry signal and a transmission signal. The second semiconductor device may generate selection codes and a control signal in response to the training entry signal. The second semiconductor device may adjust a level of a reference voltage signal for buffering the transmission signal in response to the selection codes and control a capacitance of an internal node. The reference voltage signal may be outputted from the internal node in response to the control signal.

According to an embodiment, a semiconductor device may include a selection code generation unit, a connection control unit, a voltage selection unit, a voltage stabilization control unit and a comparison unit. The selection code generation unit may generate selection codes in response to a training entry signal. The connection control unit may generate a control signal in response to the training entry signal. The voltage selection unit may select a level of a reference voltage signal in response to the selection codes and output the reference voltage signal to an internal node. The voltage stabilization control unit may control a connection of a capacitor to the internal node in response to the control signal. The comparison unit may compare the transmission signal with the reference voltage signal and may generate an internal signal.

DETAILED DESCRIPTION

Various embodiments of the present disclosure will be described hereinafter with reference to the accompanying drawings. However, the embodiments described herein are for illustrative purposes only and are not intended to limit the scope of the present disclosure.

Various embodiments may be directed to semiconductor devices and semiconductor systems including the same.

Reference voltage signal training may be used in a semiconductor system to try and prevent the malfunction of an internal circuit. Generally, the level of the reference voltage signal may be adjusted to execute an initialization operation. For example, an initialization operation may include a booting operation.

Figure 1:
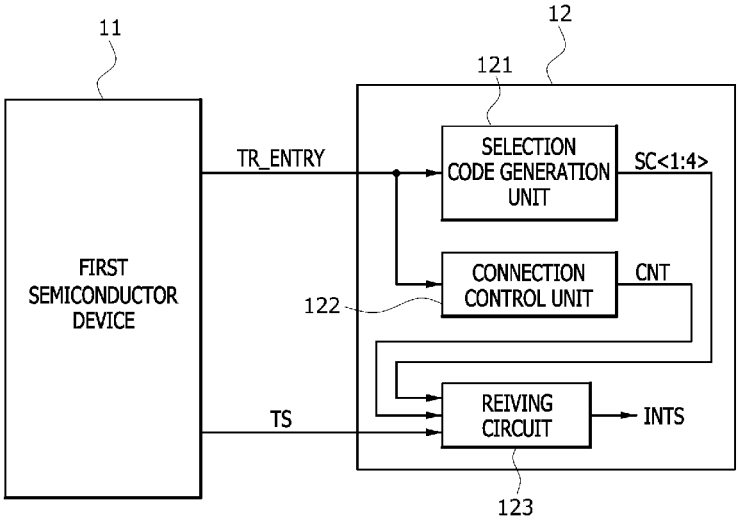
FIG. 1 is a block diagram illustrating a representation of an example of a semiconductor system according to an embodiment.

Referring to FIG. 1, a semiconductor system according to an embodiment may include a first semiconductor device 11 and a second semiconductor device 12.

The first semiconductor device 11 may apply a training entry signal TR_ENTRY and a transmission signal TS to the second semiconductor device 12. When a training mode is entered by the second semiconductor device 12, the training entry signal TR_ENTRY may be enabled to adjust a level of a reference voltage signal (VREF of FIG. 2). A logic level of the training entry signal TR_ENTRY which is enabled may be set to be different according to the various embodiments. The transmission signal TS may be used to control an internal operation of the second semiconductor device 12. The internal operation of the second semiconductor device 12 may include, for example but not limited to, a pre-charge operation, a read operation, a write operation, and a refresh operation.

The second semiconductor device 12 may include a selection code generation unit 121, a connection control unit 122 and a receiving circuit 123.

The selection code generation unit 121 may generate first to fourth selection codes SC<1:4> in response to the training entry signal TR_ENTRY. For example, the selection code generation unit 121 may output the first selection code SC<1>, the second selection code SC<2>, the third selection code SC<3> and the fourth selection code SC<4>. For example, the first selection code SC<1>, the second selection code SC<2>, the third selection code SC<3> and the fourth selection code SC<4> may be sequentially enabled when the training entry signal TR_ENTRY is enabled while in the training mode. An enabling sequence of the first selection code SC<1>, the second selection code SC<2>, the third selection code SC<3> and the fourth selection code SC<4> while in the training mode may be different according to the various embodiments.

Enabled logic levels of the first selection code SC<1>, the second selection code SC<2>, the third selection code SC<3> and the fourth selection code SC<4> may be set to be different according to the various embodiments.

The connection control unit 122 may generate a control signal CNT in response to the training entry signal TR_ENTRY. For example, the connection control unit 122 may generate an enabled control signal CNT when the training entry signal TR_ENTRY is enabled while in the training mode. An enabled logic level of the control signal CNT may be set to be different according to the various embodiments.

The receiving circuit 123 may receive the transmission signal TS in response to the first to fourth selection codes SC<1:4> and the control signal CNT and may generate an internal signal INTS. For example, the receiving circuit 123 may execute the training mode whereby the level of the reference voltage signal (VREF of FIG. 2) is adjusted in response to the first to fourth selection code SC<1:4>. In such an example, the receiving circuit 123 may control a capacitance of an internal node (nd_INT of FIG. 2). The reference voltage signal (VREF of FIG. 2) may be outputted from the internal node (nd_INT of FIG. 2) in response to the control signal CNT.

Figure 2:
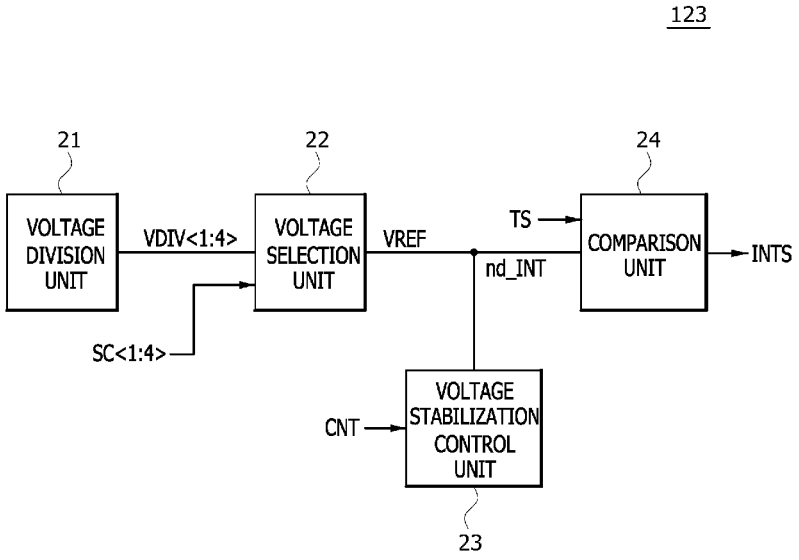
FIG. 2 is a block diagram illustrating a representation of an example of a receiving circuit included in the semiconductor system of FIG. 1.

Referring to FIG. 2, the receiving circuit 123 may include a voltage division unit 21, a voltage selection unit 22, a voltage stabilization control unit 23 and a comparison unit 24.

The voltage division unit 21 may generate first to fourth division voltage signals VDIV<1:4> by a voltage dividing operation. Voltage levels of the first to fourth division voltage signal VDIV<1:4> may be set differently according to the various embodiments.

The voltage selection unit 22 may output any one of the first to fourth division voltage signals VDIV<1:4> as the reference voltage signal VREF in response to the first to fourth selection codes SC<1:4>. A level combination of the first to fourth selection codes SC<1:4> which is enabled to select any one of the first to fourth division voltage signal VDIV<1:4> as the reference voltage signal VREF may be set differently according to the different embodiments.

The voltage stabilization control unit 23 may control coupling a capacitor (C51 of FIG. 5) to the internal node nd_INT in response to the control signal CNT. The voltage stabilization control unit 23 may terminate coupling the capacitor (C51 of FIG. 5) to the internal node nd_INT when the control signal CNT is, for example, enabled.

The comparison unit 24 may compare the transmission signal TS with the reference voltage signal VREF and generate the internal signal INTS. The comparison unit 24 may generate the internal signal INTS having a logic high level when a level of the transmission signal TS is higher than a level of the reference voltage signal VREF. The comparison unit 24 may generate the internal signal INTS having a logic low level when the level of the transmission signal TS is lower than a level of the reference voltage signal VREF. Logic levels of the transmission signal TS, the reference voltage signal VREF and the internal signal INTS may be set differently according to the various embodiments.

Figure 3:
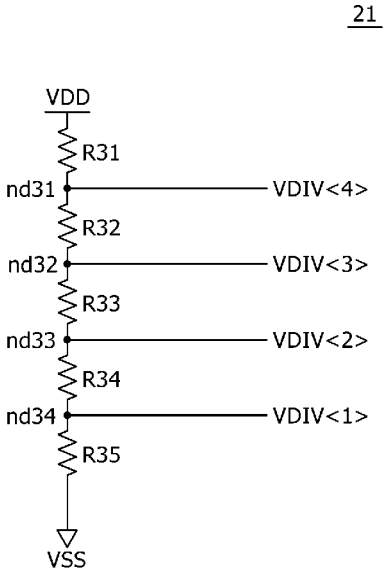
FIG. 3 is a circuit diagram illustrating a representation of an example of a voltage division unit included in the receiving circuit of FIG. 2.

Referring to FIG. 3, the voltage division unit 21 may include resistive elements R31, R32, R33, R34 and R35. The resistive element R31 may be coupled between a power supply voltage VDD terminal and a node ND31. The resistive element R32 may be coupled between the node ND31 and a node ND32. The resistive element R33 may be coupled between the node ND32 and a node ND33. The resistive element R34 may be coupled between the node ND33 and a node ND34. The resistive element R35 may be coupled between the node ND34 and a ground voltage VSS terminal.

The voltage division unit 21 may output the fourth division voltage signal VDIV<4>, the third division voltage signal VDIV<3>, the second division voltage signal VDIV<2> and the first division voltage signal VDIV<1> from the node ND31, the node ND32, the node ND33 and the node ND34 by dividing a voltage level of the power supply voltage VDD terminal. Levels of the fourth division voltage signal VDIV<4>, the third division voltage signal VDIV<3>, the second division voltage signal VDIV<2> and the first division voltage signal VDIV<1> linearly decline according to the resistance values of resistive elements R31, R32, R33, R34 and R35.

Figure 4:
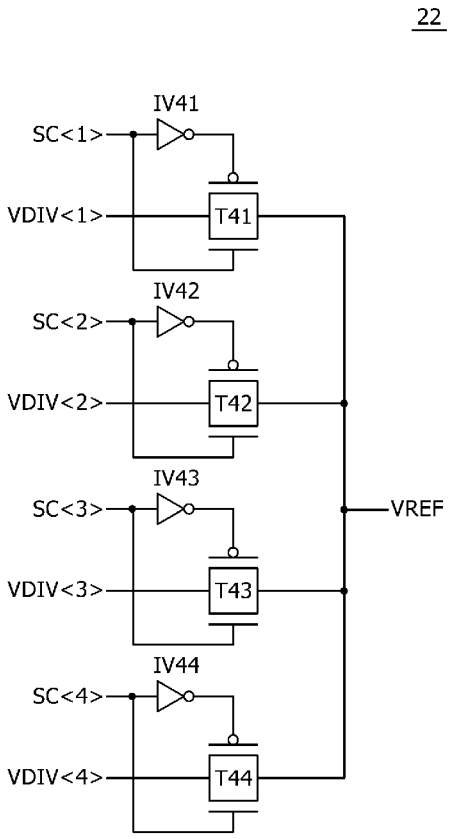
FIG. 4 is a circuit diagram illustrating a representation of an example of a voltage selection unit included in the receiving circuit of FIG. 2.

Referring to FIG. 4, the voltage selection unit 22 may include inverters IV41, IV42, IV43 and IV44 and transfer gates T41, T42, T43 and T44.

The voltage selection unit 22 may output the first division voltage signal VDIV<1> as the reference voltage signal VREF through the transfer gate T41 when the first selection code SC<1> is, for example, enabled. The voltage selection unit 22 may output the second division voltage signal VDIV<2> as the reference voltage signal VREF through the transfer gate T42 when the second selection code SC<2> is, for example, enabled. The voltage selection unit 22 may output the third division voltage signal VDIV<3> as the reference voltage signal VREF through the transfer gate T43 when the third selection code SC<3> is, for example, enabled. The voltage selection unit 22 may output the fourth division voltage signal VDIV<4> as the reference voltage signal VREF through the transfer gate T44 when the fourth selection code SC<4> is, for example, enabled.

Figure 5:
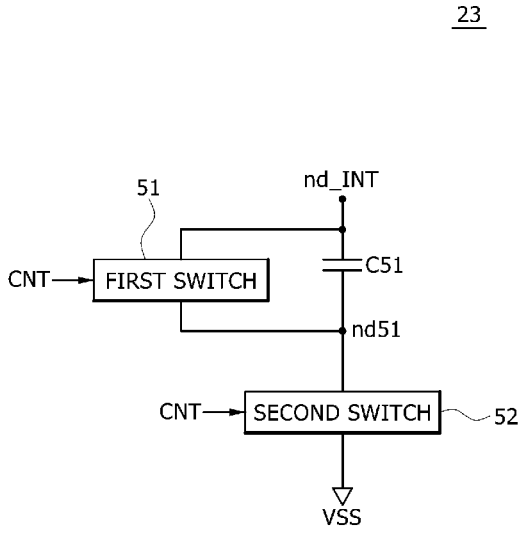
FIG. 5 is a circuit diagram illustrating a representation of an example of a voltage stabilization control unit included in the receiving circuit of FIG. 2.

Referring to FIG. 5, the voltage stabilization control unit 23 may include a first switch 51, a capacitor C51 and a second switch 52.

The first switch 51 may be coupled between an internal node nd_INT and a connection node ND51. The capacitor C51 may be coupled between the internal node nd_INT and the connection node ND51 in parallel with the first switch 51. The second switch 52 may be coupled between the connection node ND51 and the ground voltage VSS terminal.

For example, the first switch 51 is turned on and the second switch 52 is turned off when the control signal CNT is enabled. The voltage stabilization control unit 23 may connect the capacitor C51 to the internal node nd_INT when a training mode has not been entered and may disconnect the capacitor C51 to the internal node nd_INT when a training mode has been entered.

As described above, the semiconductor system according to the embodiments may connect the capacitor C51 to the internal node nd_INT from which the reference voltage signal VREF is outputted when a training mode has not been entered. The capacitor C51 may operate as a voltage stabilizer to prevent the reference voltage signal VREF from fluctuating according to variations in the process/voltage/temperature (PVT) conditions. The semiconductor system according to the embodiments may adjust the level of the reference voltage signal VREF according to the first selection code SC<1>, the second selection code SC<2>, the third selection code SC<3> and the fourth selection code SC<4> which are sequentially enabled when the training entry signal TR_ENTRY is enabled while in the training mode. In such an example, the semiconductor system may disconnect the capacitor C51 to the internal node nd_INT where the reference voltage signal VREF is outputted from. The reference voltage signal VREF may be driven rapidly by the first to fourth selection codes SC<1:4> while in the training mode because the capacitor C51 is disconnected from the internal node nd_INT.

Figure 6:
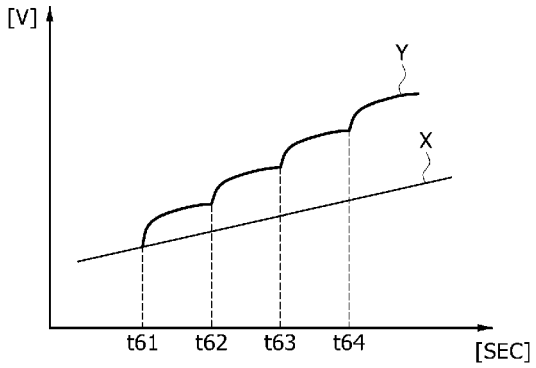
FIG. 6 is a graph illustrating a representation of an example of an operation of the semiconductor system of FIG. 1.

Referring to FIG. 6, a operation speed of the training mode executed in a semiconductor system according to various embodiments may increase in comparison with a conventional semiconductor system.

That is, a level variation of the reference voltage signal VREF in case Y that the capacitor C51 is disconnected with the internal node nd_INT rapidly varies more than and is less stable than that of the reference voltage signal VREF in case X when the capacitor C51 is connected with the internal node nd_INT at points of time T61, T62, T63, T64 when the first selection code SC<1>, the second selection code SC<2>, the third selection code SC<3> and the fourth selection code SC<4> are sequentially enabled.

Figure 7:
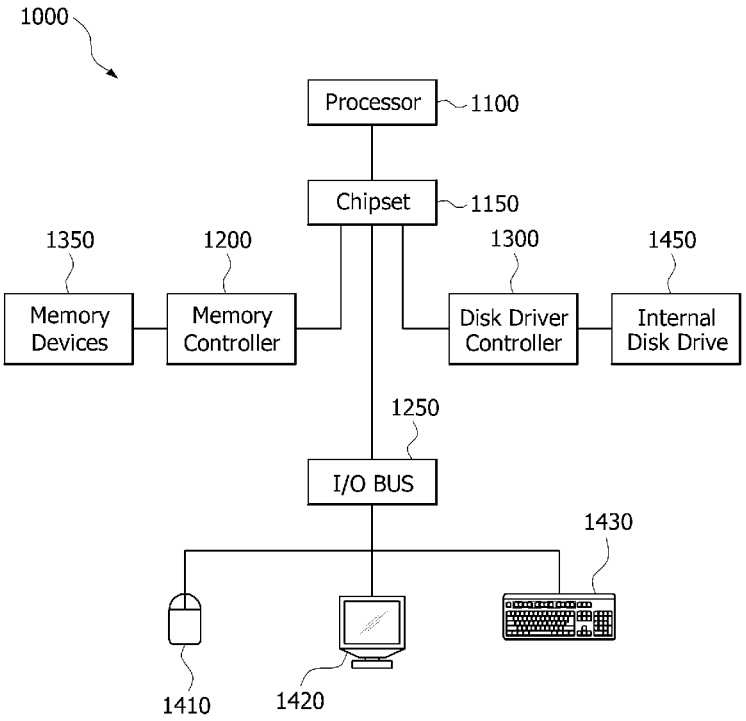
FIG. 7 illustrates a block diagram of an example of a representation of a system employing a semiconductor system and or semiconductor device in accordance with the various embodiments discussed above with relation to FIGS. 1-6.

The semiconductor devices and/or semiconductor systems discussed above (see FIGS. 1-6) are particular useful in the design of memory devices, processors, and computer systems. For example, referring to FIG. 7, a block diagram of a system employing a semiconductor device and/or semiconductor system in accordance with the various embodiments are illustrated and generally designated by a reference numeral 1000. The system 1000 may include one or more processors (i.e., Processor) or, for example but not limited to, central processing units ("CPUs") 1100. The processor (i.e., CPU) 1100 may be used individually or in combination with other processors (i.e., CPUs). While the processor (i.e., CPU) 1100 will be referred to primarily in the singular, it will be understood by those skilled in the art that a system 1000 with any number of physical or logical processors (i.e., CPUs) may be implemented.

A chipset 1150 may be operably coupled to the processor (i.e., CPU) 1100. The chipset 1150 is a communication pathway for signals between the processor (i.e., CPU) 1100 and other components of the system 1000. Other components of the system 1000 may include a memory controller 1200, an input/output ("I/O") bus 1250, and a disk driver controller 1300. Depending on the configuration of the system 1000, any one of a number of different signals may be transmitted through the chipset 1150, and those skilled in the art will appreciate that the routing of the signals throughout the system 1000 can be readily adjusted without changing the underlying nature of the system 1000.

As stated above, the memory controller 1200 may be operably coupled to the chipset 1150. The memory controller 1200 may include at least one semiconductor device and/or semiconductor system as discussed above with reference to FIGS. 1-6. Thus, the memory controller 1200 can receive a request provided from the processor (i.e., CPU) 1100, through the chipset 1150. In alternate embodiments, the memory controller 1200 may be integrated into the chipset 1150. The memory controller 1200 may be operably coupled to one or more memory devices 1350. In an embodiment, the memory devices 1350 may include the at least one semiconductor device and/or semiconductor system as discussed above with relation to FIGS. 1-6, the memory devices 1350 may include a plurality of word lines and a plurality of bit lines for defining a plurality of memory cells. The memory devices 1350 may be any one of a number of industry standard memory types, including but not limited to, single inline memory modules ("SIMMs") and dual inline memory modules ("DIMMs"). Further, the memory devices 1350 may facilitate the safe removal of the external data storage devices by storing both instructions and data.

The chipset 1150 may also be coupled to the I/O bus 1250. The I/O bus 1250 may serve as a communication pathway for signals from the chipset 1150 to I/O devices 1410, 1420, and 1430. The I/O devices 1410, 1420, and 1430 may include, for example but are not limited to, a mouse 1410, a video display 1420, or a keyboard 1430. The I/O bus 1250 may employ any one of a number of communications protocols to communicate with the I/O devices 1410, 1420, and 1430. In an embodiment, the I/O bus 1250 may be integrated into the chipset 1150.

The disk driver controller 1300 may be operably coupled to the chipset 1150. The disk driver controller 1300 may serve as the communication pathway between the chipset 1150 and one internal disk driver 1450 or more than one internal disk driver 1450. The internal disk driver 1450 may facilitate disconnection of the external data storage devices by storing both instructions and data. The disk driver controller 1300 and the internal disk driver 1450 may communicate with each other or with the chipset 1150 using virtually any type of communication protocol, including, for example but not limited to, all of those mentioned above with regard to the I/O bus 1250.

It is important to note that the system 1000 described above in relation to FIG. 7 is merely one example of a system 1000 employing a semiconductor device and/or semiconductor system as discussed above with relation to FIGS. 1-6. In alternate embodiments, such as, for example but not limited to, cellular phones or digital cameras, the components may differ from the embodiments illustrated in FIG. 7.

What is claimed is:

1. A semiconductor system comprising:

a first semiconductor device configured for outputting a training entry signal and a transmission signal; and a second semiconductor device configured for generating selection codes and a control signal in response to the training entry signal, adjusting a level of a reference voltage signal for buffering the transmission signal in response to the selection codes and outputting the reference voltage signal to an internal node, wherein the second semiconductor device comprises a voltage stabilization control unit configured for controlling a connection of a capacitor to the internal node in response to the control signal.

2. The semiconductor system of claim 1, wherein when the second semiconductor device is in a training mode, the training entry signal has a predetermined logic level to adjust the level of the reference voltage signal.

3. The semiconductor system of claim 1, wherein the selection codes comprise a first selection code and a second selection code, and the first selection code has a first logic level and the second selection code has a second logic level in response to the training entry signal.

4. The semiconductor system of claim 3, wherein the reference voltage signal is adjusted to a first level when the first selection code has the first logic level and a second level when the second selection code has the second logic level.

5. The semiconductor system of claim 1, wherein a capacitor is disconnected from the internal node when the control signal has the first logic level and the capacitor is connected with the internal node when the control signal has the second logic level.

6. The semiconductor system of claim 1, wherein the second semiconductor device comprises:

a selection code generation unit configured for generating the selection codes in response to the training entry signal; and a connection control unit configured for generating the control signal in response to the training entry signal.

7. The semiconductor system of claim 6, wherein the second semiconductor device comprises a receiving circuit configured for receiving the transmission signal in response to the selection codes and the control signal, and generating an internal signal.

8. The semiconductor system of claim 1, wherein the selection codes comprise a first selection code and a second selection code, and wherein the second semiconductor device comprises:

a voltage selection unit configured for selecting any one of either a first division voltage signal or a second division voltage signal as the reference voltage signal in response to the first selection code and the second selection code, and outputting the reference voltage signal to the internal node.

9. The semiconductor system of claim 8, wherein the first division voltage signal is selected as the reference voltage signal when the first selection code has the first logic level and the second division voltage signal is selected as the reference voltage signal when the second selection code has the second logic level.

10. The semiconductor system of claim 9, wherein the voltage stabilization control unit comprises:

a capacitor configured for being coupled between the internal node and a connection node;

a first switch configured for being coupled between the internal node and a connection node in parallel with the capacitor;

a second switch configured for being coupled between the connection node and a ground voltage terminal.

11. The semiconductor system of claim 10, wherein the first switch is turned on and the second switch is turned off when the control signal has a predetermined logic level.

12. The semiconductor system of claim 10, wherein the voltage stabilization control unit terminates coupling the capacitor to the internal node when the control signal is enabled.

13. The semiconductor system of claim 1, wherein the second semiconductor device comprises a comparison unit configured for comparing the transmission signal with the reference voltage signal and generating the internal signal.

* * * * *